US005651712A

United States Patent [19]

Potter

[11] Patent Number: 5,651,712

[45] Date of Patent: Jul. 29, 1997

[54] MULTI-CHROMIC LATERAL FIELD EMISSION DEVICES WITH ASSOCIATED DISPLAYS AND METHODS OF FABRICATION

[75] Inventor: Michael David Potter, Grand Isle, Vt.

[73] Assignee: International Business Machines Corporation, Armonk, N.Y.

[21] Appl. No.: 555,743

[22] Filed: Nov. 9, 1995

Related U.S. Application Data

[62] Division of Ser. No. 324,633, Sep. 18, 1994.

[51] Int. Cl.[6] ..... H01J 1/72

[52] U.S. Cl. ..... 445/24; 313/496

[58] Field of Search ..... 445/24; 313/422, 313/495, 496, 497, 309, 336; 345/55, 74

[56] References Cited

U.S. PATENT DOCUMENTS

| | | | |
|---|---|---|---|
| 4,728,851 | 3/1988 | Lambe | 313/309 |
| 4,781,438 | 11/1988 | Noguchi | 445/24 X |
| 4,857,799 | 8/1989 | Spindt et al. | 313/496 X |
| 5,103,144 | 4/1992 | Dunham | 313/336 X |
| 5,144,191 | 9/1992 | Jones et al. | 313/308 |
| 5,148,079 | 9/1992 | Kado et al. | 313/309 |
| 5,225,820 | 7/1993 | Clere | 345/55 |
| 5,233,263 | 8/1993 | Cronin et al. | 313/309 |
| 5,281,891 | 1/1994 | Kaneko et al. | 313/309 |
| 5,308,439 | 5/1994 | Cronin et al. | 156/656 |
| 5,396,149 | 3/1995 | Kwon | 345/72 |

*Primary Examiner*—Kenneth J. Ramsey
*Attorney, Agent, or Firm*—Heslin & Rothenberg, P.C.

[57] ABSTRACT

Multi-chromic lateral field emission devices ("FEDs") and methods of fabrication are set forth. The multi-chromic FEDs include a phosphor layer disposed substantially perpendicular to an emission surface. Associated with the phosphor layer are multiple emission regions, and associated with each emission region is an emitter and a filter. Operationally, when electrons are transferred from an emitter into the phosphor layer, a light emission is produced from the associated emission region. The associated filter selectively passes desired wavelengths of light. Specific details of the field emission device, an associated display, and fabrication methods are set forth.

26 Claims, 6 Drawing Sheets

MULTI-CHROMIC LATERAL FIELD EMISSION DEVICES WITH ASSOCIATED DISPLAYS AND METHODS OF FABRICATION

This application is a division of application Ser. No. 08/324,633, filed Sep. 18, 1994, which application is now pending.

TECHNICAL FIELD

This invention relates in general to electronic displays for use in computers and electronic devices. More particularly, the invention relates to a novel multi-chromic display using lateral field emission devices as the display elements.

BACKGROUND OF THE INVENTION

Electronic displays are fundamental to the use of modern computer and electronic equipment. Historically, cathode ray tube ("CRT") based displays have been the primary display choice. CRTs, however, continue to present several engineering problems when used in electronic devices. The large size and awkward geometrics of CRTs severely limit their ability to be integrated into small electronic devices. Furthermore, CRTs require high power supply voltages and complex analog control electronics. Taken together, these problems severely limit the usefulness of CRTs in miniature electronic devices.

Liquid crystal displays ("LCDs") represent an alternate display technology for use in electronic devices. Although smaller and flatter than CRTs, use of LCDs presents several problems. Production yields of LCD displays remain generally low, making cost of fabrication relatively high. Moreover, LCD displays typically include relatively large "pixels," limiting the level of miniaturization and resolution that can be achieved. Further, the speed of LCD displays is relatively limited, making usefulness in real time video displays troublesome.

Recently, field emission devices ("FEDs") or microvacuum tubes have gained popularity as possible alternatives to conventional semiconductor silicon devices. Although typical applications associated with FEDs range from discrete active devices to high density memories, displays represent a key area in which FED technology has significant potential. However, as of this date, no practical, easy to fabricate, low voltage, full color FED display has been disclosed. The present invention is directed towards solving these problems.

DISCLOSURE OF THE INVENTION

The present invention comprises, in a first aspect, a field emission device ("FED") for emitting electromagnetic energy. The FED includes a phosphor structure which has multiple emission regions. The FED also includes multiple emitters which are separately electrically controllable. Further, each emitter is associated with an emission region of the multiple emission regions. Operationally, electrons emitted by each emitter into the phosphor layer cause an electromagnetic emission from an associated emission region.

As an enhancement, an emission region may have a filter associated therewith. A preselected wavelength of electromagnetic energy is thus emitted from the filter when electrons are emitted from the emitter associated with the emission region. Moreover, the FED may include three emission regions, each having a color filter associated therewith. The three color filters may comprise a red, green and blue color filter so as to facilitate emission of primary colors of light from the FED.

In another aspect, the present invention includes a display comprising a plurality of light emitting FEDs organized in a display matrix. A pair of adjacent FEDs within the display may have a shared emitter. Specifically, the shared emitter may have two tips, each tip being disposed at one end of two opposite ends of the shared emitter such that one tip is associated with an emission region of one FED of the pair, and the other tip is associated with an emission region of another FED of the pair.

The present invention facilitates fabrication of a multi-chromic FED and an associated display, each having significant advantages. The multi-chromic FED overcomes previous limitations of light emitting field emission devices. In particular, minimum gap and direct injection techniques lower the required operating voltages of the device. Further, fabrication of a multi-chromic device capable of producing light of any visible color is facilitated.

The present FED as applied to an associated display has significant advantages over prior display technologies. Specifically, the "speed" of FED display devices is limited primarily by the "speed" of the phosphor used, however, phosphors are currently available that provide light-dark switching times at rates far in excess of human perception. Thus, a "real-time" display is achieved. Further, extremely small displays with very high resolution are possible. As an example, if the size of each multi-chromic FED is approximately 4 microns, a full color display with a resolution of 5,000 pixels by 5,000 pixels may be formed on a square chip 2 cm on each side. This is approximately the resolution of the human eye including peripheral vision. Thus, if two such chips are mounted in an appropriate fixture (a helmet, mask, pair of glasses, etc.), a high-resolution fully immersive virtual reality display device is facilitated.

Thus, the multi-chromic FED and associated display of the present invention represent a significant advancement in the state of the art of microelectronic display elements and associated displays.

BRIEF DESCRIPTION OF THE DRAWINGS

The subject matter which is regarded as the present invention is particularly pointed out and distinctly claimed in the concluding portion of the Specification. The invention, however, both as to organization and method of practice, together with the further objects and advantages thereof, may best be understood by reference to the following detailed description taken in conjunction with the accompanying drawings in which:

BEST MODE FOR CARRYING OUT THE INVENTION

Figure 1:
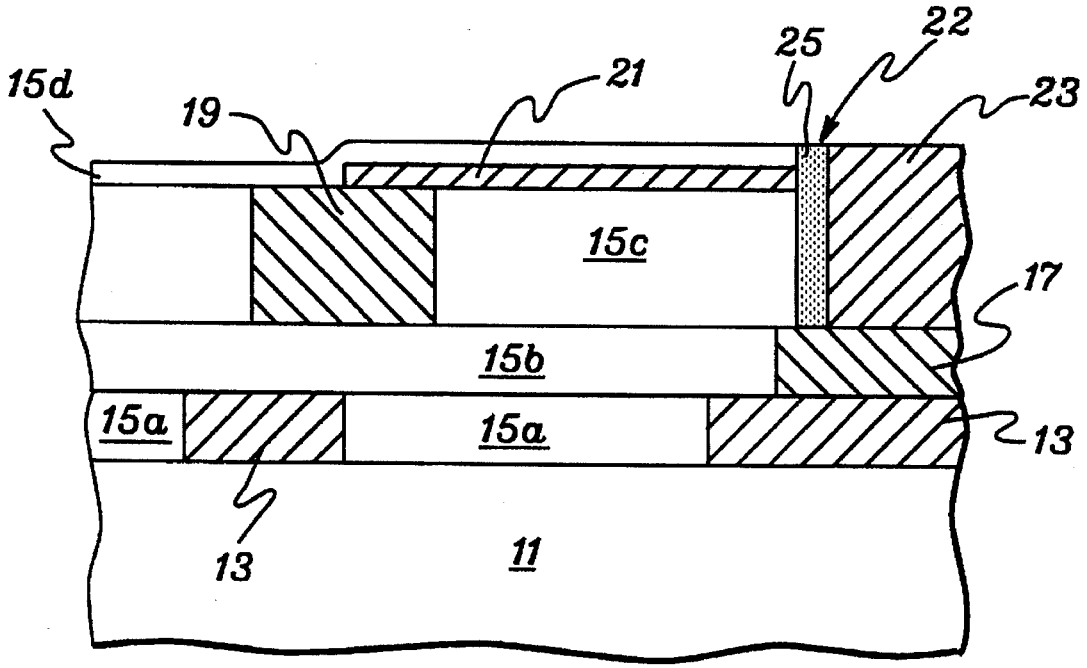
FIG. 1 is a cross-sectional view of a light emitting FED having a lateral emitter according to an embodiment of the present invention.

Certain preferred embodiments of multi-chromic field emission devices, displays formed from the same, and associated methods of fabrication are presented herein. FIG. 1 is a partial cross-sectional view of a light emitting FED including a lateral emitter. Various methods for forming FEDs having lateral emitters may be found in, for example, U.S. Pat. No. 5,233,263 entitled "Lateral Field Emission Devices," issued Aug. 3, 1993, and U.S. Pat. No. 5,308,439 entitled "Lateral Field Emission Devices and Methods of Fabrication," issued May 3, 1994. One method of fabricating the FED of FIG. 1 is described in co-pending U.S. patent application entitled "Lateral Field Emission Devices For Display Elements And Methods Of Fabrication," filed on Oct. 28, 1994, now U.S. Pat. No. 5,629,580, and hereby incorporated herein by reference. Although described therein in detail, the method will be briefly summarized below.

Substrate 11 of the FED of FIG. 1 can comprise any glass, metal, ceramic, etc., capable of withstanding the elevated temperatures (e.g., 450° C.) typically encountered during the device fabrication processes described below. Fabrication begins with the formation of first metallization layer 13 on substrate 11 using standard damascene processing. By way of example, insulating layer 15*a* comprising an oxide is deposited on substrate 11. Grooves for metallization are next patterned and etched within the insulating layer. A blanket chemical vapor deposition ("CVD") of a conductor, such as, for example, tungsten, fills the etched grooves to form first metallization layer 13. The assembly is then planarized so that the tungsten resides only in the patterned oxide grooves.

The next layer comprising insulator 15*b* and anode stud 17 is formed, again using standard damascene processing. Stud 17 is located so as to later become a base contact for the anode. Thus, electrical connectivity to the later-formed anode is facilitated through the first metallization layer which is in direct electrical and mechanical contact with the stud. Optionally, the anode stud may be omitted and electrical contact to the anode may be made directly from the first metallization layer.

Next, insulating layer 15*c* and second metallization layer 19 are formed above the previous layer. It should be noted that structures 25 and 23 have not yet been fabricated at this point in the process. Emitter 21 is then fabricated, to be in electrical contact with second metallization layer 19. Thin insulation layer 15*d* is formed above the emitter for protection. A hole is etched through insulating layer 15*d*, emitter 21 and insulating layer 15*c* down to buried anode stud 17. Again, this etch is performed through emitter 21, which produces an emitter tip automatically aligned with the anode opening and hence the later formed anode. A phosphor structure comprising phosphor layer 25 is then deposited on the vertical sidewalls of the hole by standard processes. As a general note, the bottom of the hole must be kept clean so that the later formed anode may electrically contact stud 17. Metal comprising anode 23 is next deposited within the hole, so as to fill it. Thus, a columnar-shaped anode is formed with a phosphor layer adjacent to its lateral surfaces. As will be discussed later, in one embodiment of the present invention, the anode is formed in a triangular prismatic shape (see, for example, the top view of FIG. 1*a*).

Operationally, when a voltage potential of sufficient magnitude is applied between the emitter and the anode, electrons are directly injected from the emitter into the phosphor layer, towards the anode. Because emitter 21 comprises a thin-film metallization layer, the radius of curvature across the tip of the emitter is small enough to create the high electric field necessary for operation of the FED. Due to the direct contact of the emitter tip to the phosphor layer, phosphor layer 25 must comprise an insulative-type phosphor, for example, $Z_nS_iO_4:M_n$. The continuous phosphor layer, upon application of a sufficient voltage potential, will glow emitting light at an upper emission surface 22.

Figure 3:
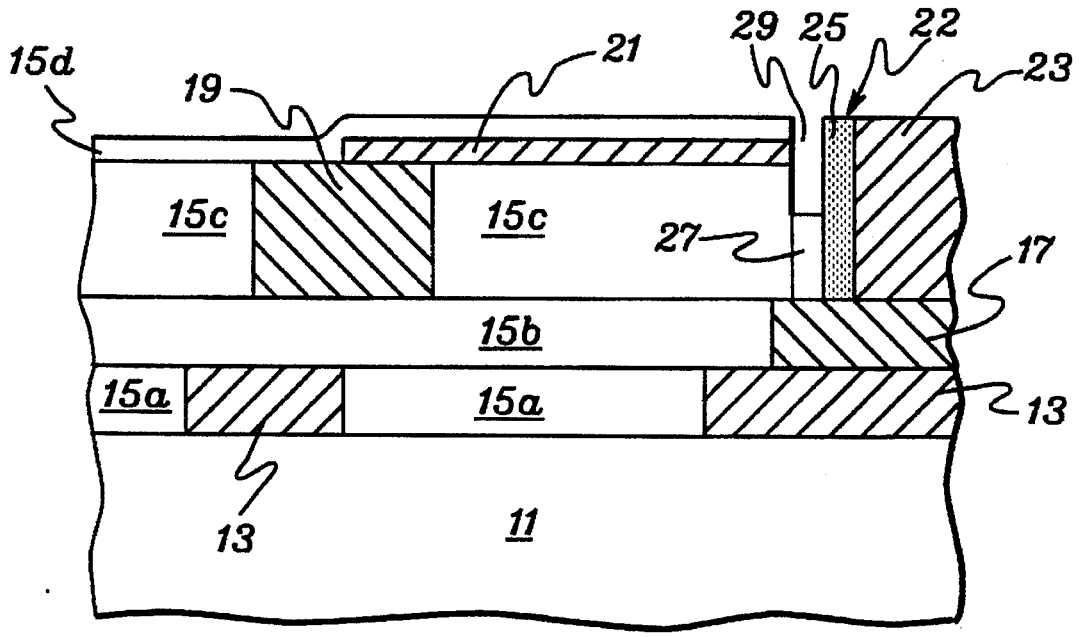
FIG. 3 is an alternate embodiment of a light emitting FED using minimum gap electron injection techniques in conformance with an embodiment of the present invention.

In an alternate embodiment of the present invention (shown in FIGS. 3 and 3*a*), conductive phosphors may be used. Such an embodiment can be fabricated as follows. After the anode hole is etched, and before the phosphor layer is deposited, a sacrificial insulating layer 27 is deposited within the hole. Processing then continues as before (FIGS. 1 and 1*a*) with the forming of both phosphor layer 25 and anode 23. Thereafter, a portion of sacrificial insulating layer 27 may be removed to create a gap between the emitter tip and the phosphor layer. Optionally, the sacrificial insulating layer may be left intact. The thickness of sacrificial insulating layer 27, which corresponds to the distance between the emitter tip and the phosphor layer, is preferably less than the mean free path distance of an electron in air. Thus, if there is air within "minimum gap" 29, the "minimum gap" becomes a virtual vacuum because there is a reduced likelihood of an electron encountering an air molecule as it passes from the emitter to the phosphor layer. This FED may therefore be used in an environment in which evacuation or an inert gas atmosphere is unnecessary.

The basic structure described hereinabove can be used pursuant to the present invention to form a tri-chromic FED for use in a display matrix. With such a use, color generating means are preferably provided within each FED (i.e., display element). As shown in FIGS. 2, 2*a*, and 4, 4*a*, insulating layer 15*e* is formed above emission surface 22, and planarized. Thereafter, filter 31 is formed within the insulation layer, above the "emission region" defined by emitter 21 and continuous phosphor layer 25. The filter is formed within insulating layer 15*e* using a combination of process steps of which each individual step is known in the art. For example, an opening is etched within the insulating layer, followed by spin deposition of filter material into the opening. Thereafter, a planarization process removes all excess filter material other than that contained within the etched hole. Each filter is preferably specifically designed to allow only a predetermined wavelength or combination of wavelengths of light through. Of course, when energized, continuous phosphor layer 25 must emit the desired wavelength of light for transmission through the filter. For example, if a blue color of light is desired, a blue filter (31) is used in conjunction with a phosphor layer which generates light wavelengths in the blue region (other colors of light may also be generated, but are blocked by the blue filter).

The techniques of the present invention may be extended to form an FED capable of emitting multiple colors of light.

Figure 1A:
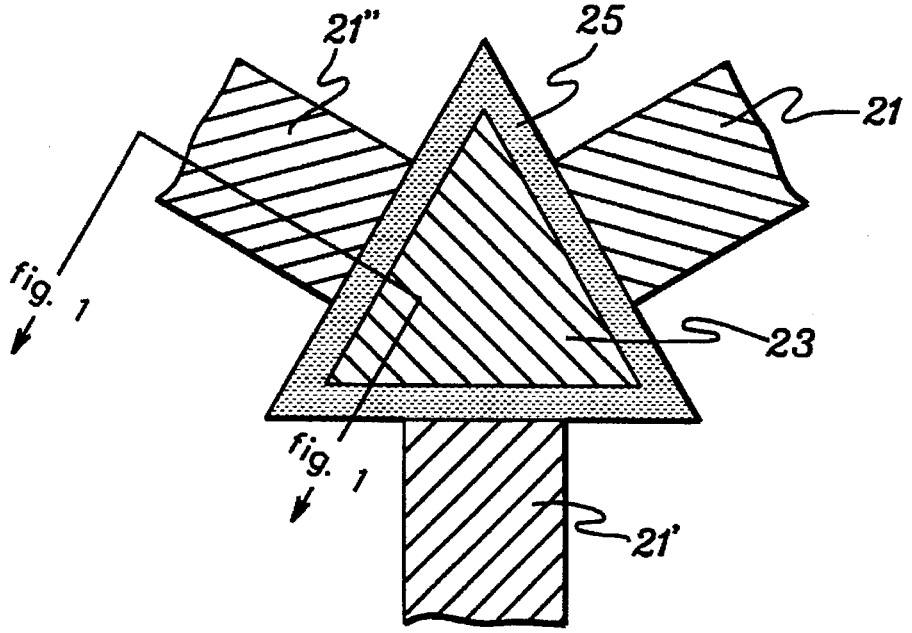
FIG. 1*a* is a top schematic view of the FED of FIG. 1 pursuant to an embodiment of the present invention having three emission regions.
Figure 3A:
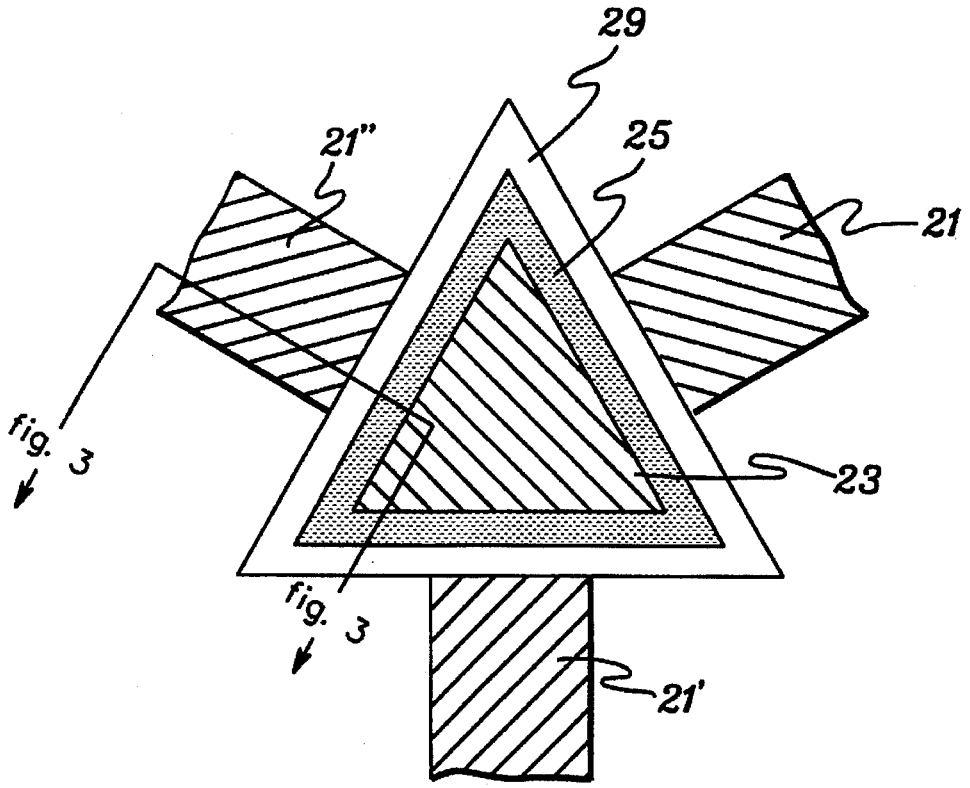
FIG. 3*a* is a top schematic view of the FED of FIG. 3 pursuant to an embodiment of the present invention having three emission regions.

FIGS. 1*a* and 3*a* depict top schematic views of FEDs with three lateral emitters and three corresponding emission regions prior to filter formation. Anode 23 is formed as a triangular prism of which the triangular-shaped end surface of the anode is shown. This shape facilitates formation of an FED with three emission regions, each emission region corresponding to one lateral surface of the triangular prism. Thus, each emission region also corresponds to each edge surface of the triangular phosphor region shown in FIGS. 1*a* and 3*a*. In forming the FED of FIG. 1*a*, the structure shown in FIG. 1 is replicated thrice around triangular anode 23. Specifically, all three emission structures are fabricated simultaneously by using common mask and etch processes. By way of illustration, reference should be made to the sectional line indicating the orientation of the structure of FIG. 1 with respect to FIG. 1*a*.

Phosphor layer 25 is preferably continuous, and disposed adjacent to the lateral surfaces of the anode. As a result, a triangular-shaped phosphor region is formed flush with the top surface (i.e., emission surface 22, FIG. 1) of the FED and the triangular-shaped end of the anode. The three emitters, 21, 21' and 21" each directly contact the phosphor layer. Therefore, in this embodiment a "direct injection" of electrons into the phosphor layer towards the anode is achieved, which means that a non-conductive phosphor material must be used. In an alternate embodiment such as that of FIGS. 3–4*a*, minimal gap techniques may be used in conjunction with a conductive phosphor layer. In either the "direct injection" or "minimum gap" case, three emission regions are defined on the emission surface. Each emission region corresponds to one edge of the triangular phosphor region on the emission surface, which also corresponds to one lateral surface of the anode.

Figure 2:
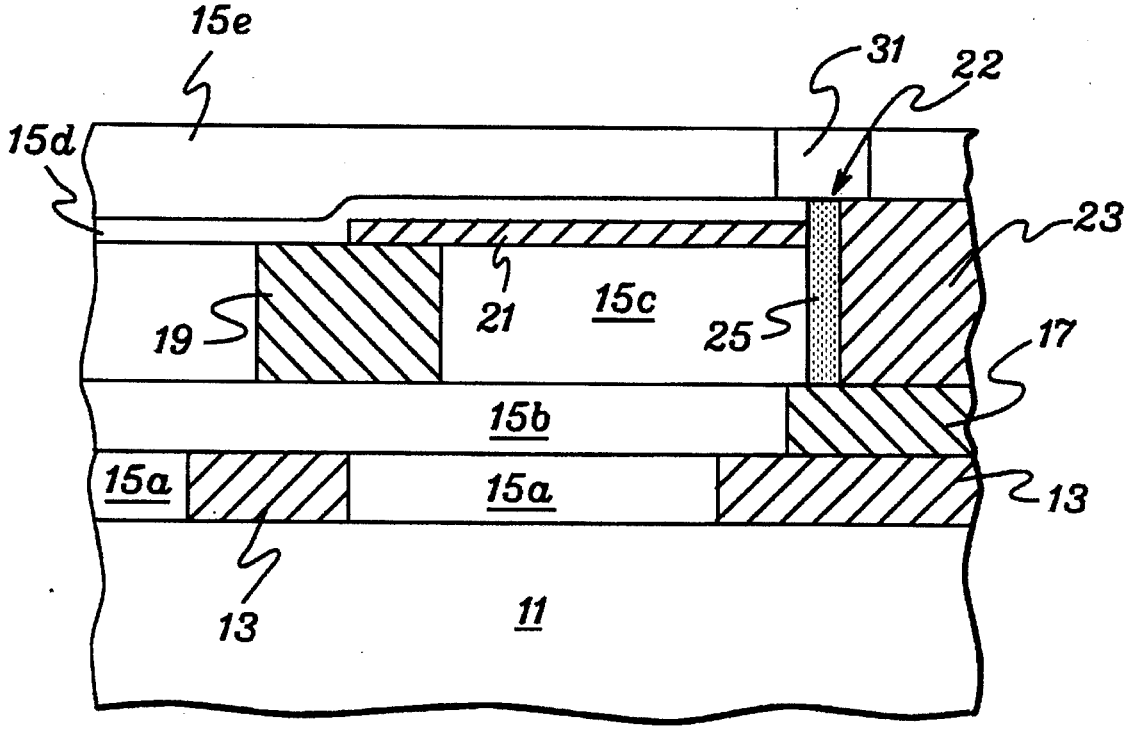
FIG. 2 is a cross-sectional view of the FED of FIG. 1 subsequent to the formation of a filter above the emission surface according to one embodiment of the present invention.
Figure 2A:
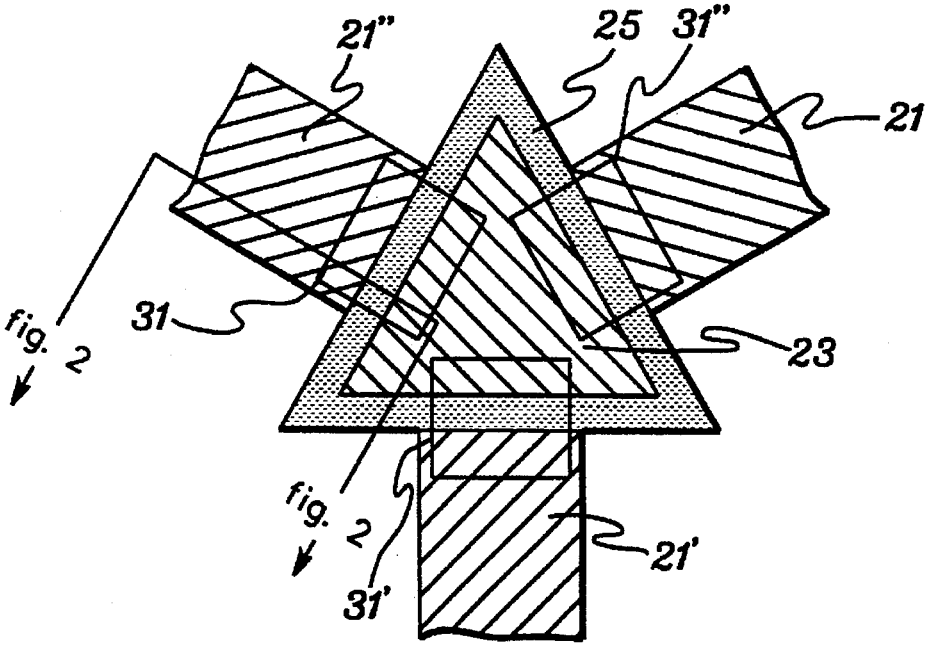
FIG. 2*a* is a top schematic view of the FED of FIG. 2 according to an embodiment of the present invention having three filters.
Figure 4:
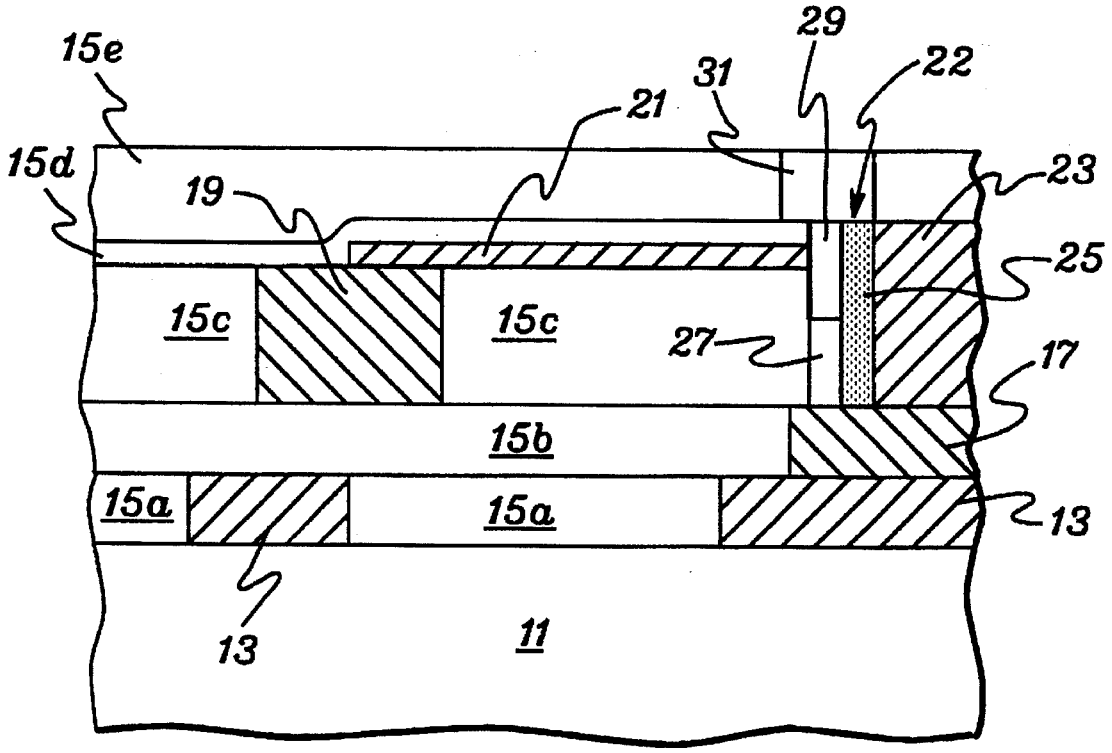
FIG. 4 is a cross-sectional view of the FED of FIG. 3 subsequent to the formation of a filter above the emission surface according to one embodiment of the present invention.
Figure 4A:
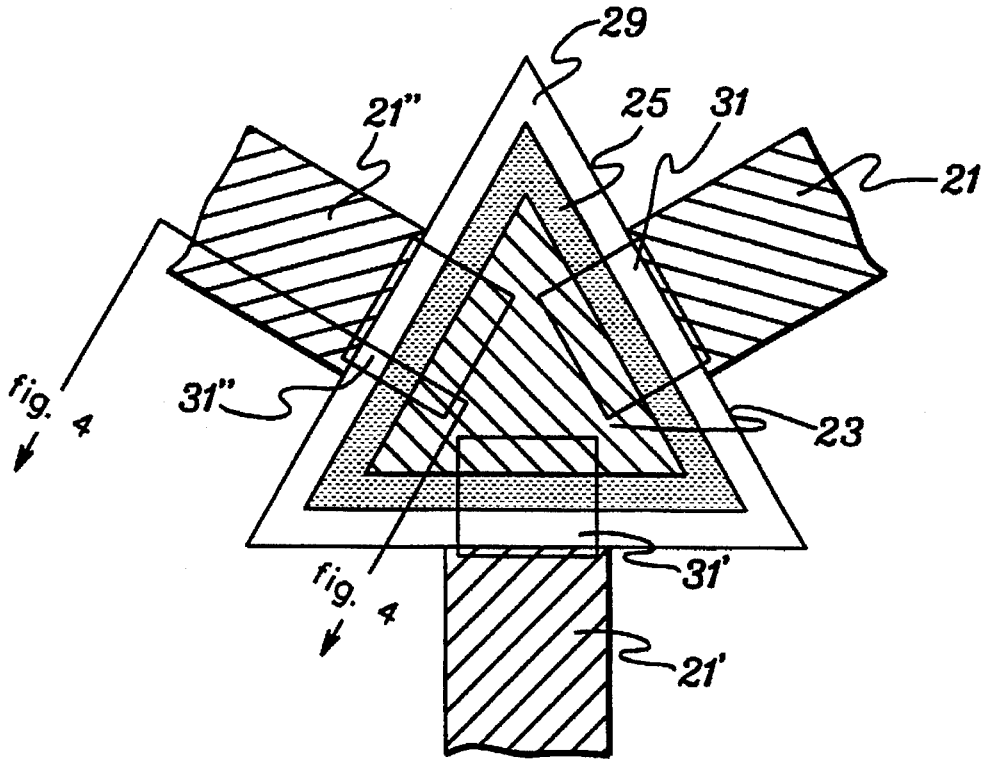
FIG. 4*a* is a top schematic view of the FED of FIG. 4 according to an embodiment of the present invention having three filters.

As previously discussed, a filter may be disposed above the emission region of a FED to allow only certain wavelengths of light to be emitted from the emission region. The same general principle is applicable to FEDs having three emission regions each with its own filter so as to form a FED capable of tri-chromic emissions (FIGS. 2*a* and 4*a*). If primary colors are desired, i.e., red, green and blue, then a tri-chromic display with primary color capability is produced. For example, filters 31, 31' and 31" may comprise red, green and blue filters, respectively. In such a case, it should generally be noted that phosphor layer 25 should comprise a phosphor with a broad-band emission of wavelengths of light which includes all desired colors. One example of such a broad-band phosphor is zinc oxide—ZnO. During operation, by appropriately controlling the intensities of the three available colors, the entire visible spectrum of color may be produced. Such color combination and control techniques will be apparent to one of ordinary skill in the art and are not discussed further herein.

The process used to create three different filters, each associated with one of three emission regions of a FED, involves a modification of the process described above for creating a single filter. Namely, for each of the three filters, the process includes etching a hole in insulating layer 15*e* over the designated emission region. Filter material is then spin deposited, filling the hole. Next, the surface of insulating layer 15*e* is cleared of excess filter material. Thus, after performing the above-described process three times, three filters are created.

As an extension of the tri-chromic FED disclosed herein, a novel display comprising a "display matrix" of tri-chromic FEDs (FIG. 5) can be constructed. Each FED comprises a "pixel" of the display, and each pixel is capable of producing any visible color. Each FED/pixel actually comprises three pixels, i.e., red, green and blue, but the eye combines these to form a single full-color pixel. By appropriately activating combinations of FEDs in the display, images may be formed. Various techniques for controlling color displays will be apparent to one of ordinary skill in the art and are not discussed further herein.

Figure 5:
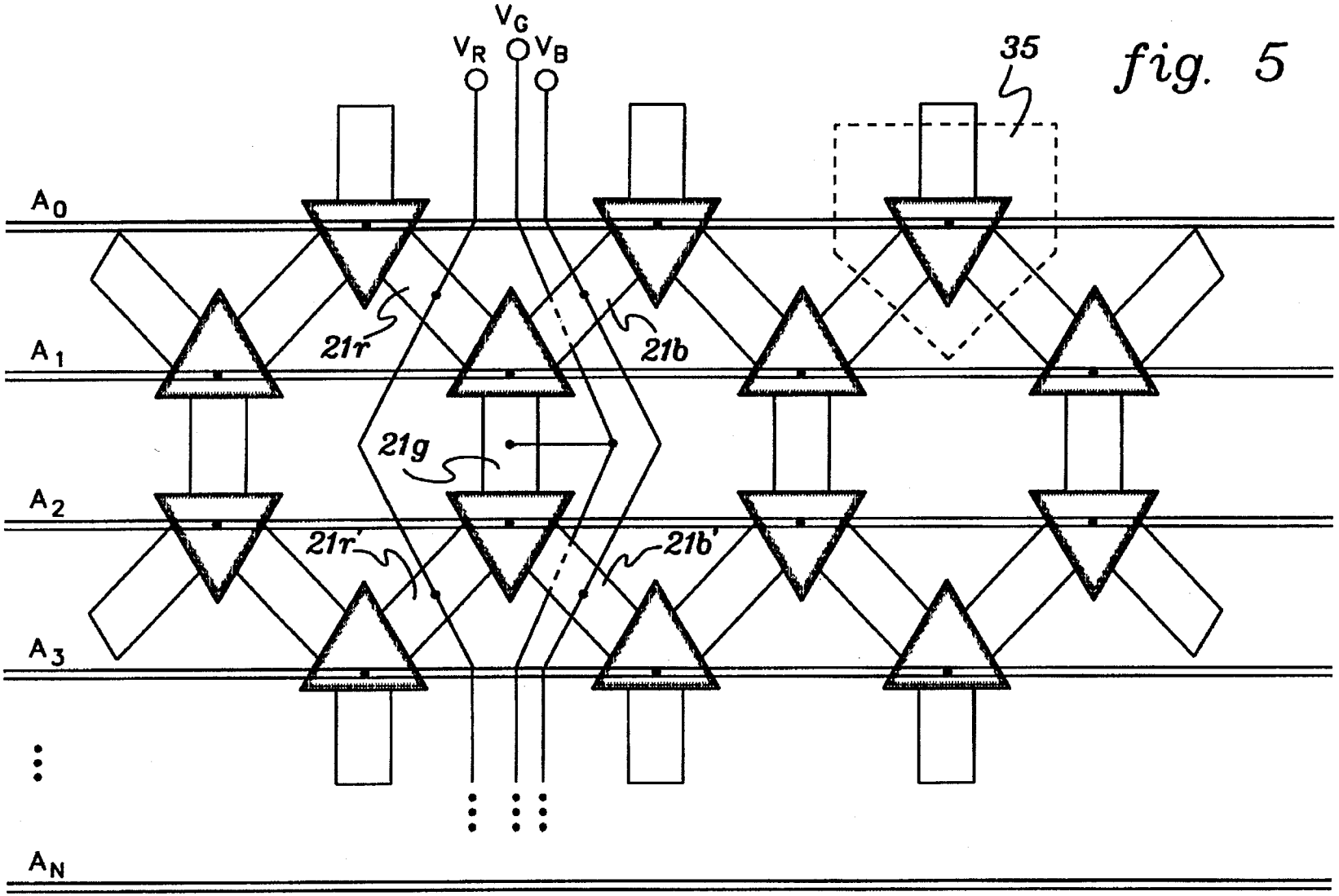
FIG. 5 is a top schematic view of a display comprising the tri-chromic FEDs of the present invention.

The triangular geometry of the tri-chromic FEDs of the display shown in FIG. 5 facilitates a convenient manner of interconnection. As shown, a separate row address line ($A_0 \ldots A_N$) is provided for each row of FEDs. Specifically, each row address line electrically connects to the anode of each FED in a particular row. The address line may comprise, for example, the first metallization layer (first metallization layer 13, FIG. 1) of each FED. Thus, row address lines electrically interconnecting the FEDs may be formed simultaneously with the base layers of each FED, i.e., each of the FEDs of the display can be formed by common mask and etch processes on a single substrate.

Connection to the FED's emitters is also necessary to facilitate addressing and operation of the display. The triangular FED structure of the present invention facilitates a very efficient emitter interconnect scheme. As shown in the expanded view of FIG. 5*a*, emitters are shared by pairs of FEDs, e.g., emitters 21*r*, 21*g* and 21*b*. During fabrication, the thin-film emitters are deposited and patterned such that shared emitters result. As an example, shared emitter 21*r* has two tips, each at an opposite end of the emitter. One tip is associated with an emission region of FED 35*a*, while the other tip is associated with an emission region of FED 35*b*. Thus, when a voltage potential of sufficient magnitude is created between a shared emitter and one (or both) of the associated anodes, electrons are transferred to the corresponding phosphor layer(s) resulting in light emission.

Figure 5A:
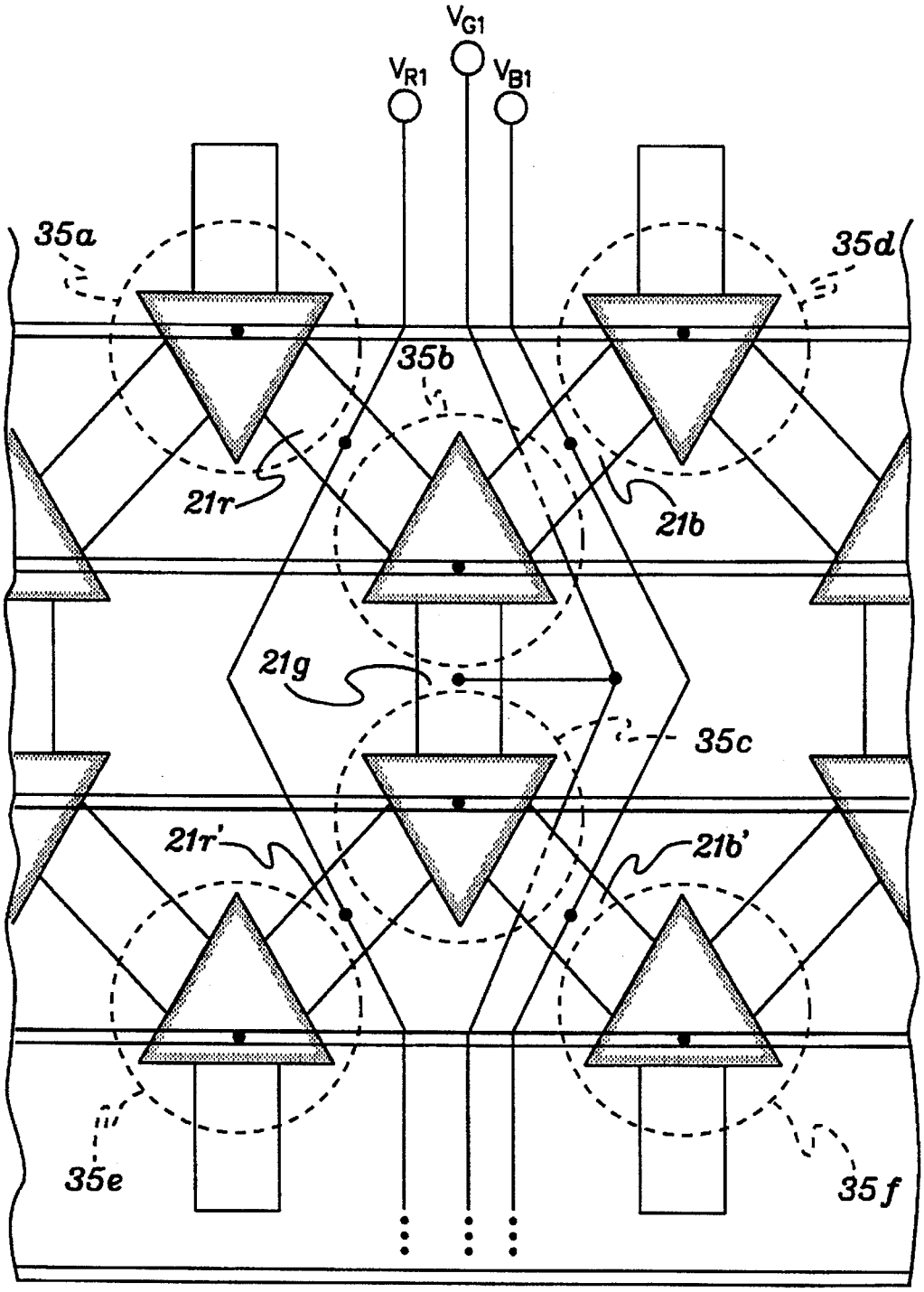
FIGS. 5*a* is an expanded view of the display of FIG. 5.

The "shared emitter" feature of the present invention facilitates improved addressing of the display. Again, each shared emitter corresponds to two emission regions. Identical filters can be associated with each of the two emission regions such that the shared emitter can correspond to the same color on each of two adjacent FEDs. For example, as shown in FIG. 5*a*, shared emitter 21*r* corresponds to emission regions associated with FED 35*a* and FED 35*b*. Accordingly, a red filter may be associated with the emission region corresponding to shared emitter 21*r* on each of the two FEDs.

In order to further facilitate addressing, various shared emitters can be interconnected in a manner as described hereinbelow. Each combination of two adjacent FEDs, adjacency being in any direction, and a shared emitter associated therewith is referred to herein as an "FED pair." For example, with respect to FIG. 5*a*, one adjacent FED pair comprises FED 35*a*, FED 35*b* and shared emitter 21*r*, while another FED pair comprises FED 35*e*, FED 35*c* and shared emitter 21*r'*. Note that the emission regions associated with shared emitter 21*r'* may also have red filters associated therewith.

These two "FED pairs" have their shared emitters 21*r* and 21*r'* electrically interconnected by column a address line Vr. Thus, by applying a voltage potential between column address line Vr and a selected row address line, a particular red "dot" is displayed. It is also important to note that although the red "pixels" addressed by the Vr line are not oriented precisely vertically, the eye will not perceive this offset due to the high density of the display. The filters associated with the other shared emitters are selected such that, for example, column address line Vg addresses a column of green pixels, and column address line Vb addresses a column of blue pixels. Although not shown, similar Vr, Vg and Vb lines can be disposed across the entire display, thereby providing full addressability.

Lines Vr, Vg and Vb are provided by various metallization layers within the FED structures. For example, the Vr and Vb lines may be formed entirely from second metallization layer 19 (FIG. 1). Line Vg may be formed from both the first and second metallization layers. This might be necessary in order to "route around" other metallized lines such as the Vr, Vb and row address lines. Vias are provided between the first and second metallization layers to interconnect portions of the Vg lines disposed on the two metal layers.

As a general note, the techniques of the present invention described hereinabove have been applied to a tri-chromic FED with a triangular geometry. Variations on this design are possible. In particular, other anode geometries may be used to facilitate various numbers of emission regions (e.g., a hexagonal prismatic anode could have six emission regions). Accordingly, geometrics which permit monochromic, bi-chromic, quad-chromic or displays with any other number of colors are possible using the techniques of the present invention. Further, selection of color filters is not limited to the primary colors. For example, in photographic applications, the negative primaries (cyan, magenta and yellow) may be used.

To summarize, the present invention facilitates fabrication of a tri-chromic FED and an associated display, each having significant advantages. The tri-chromic FED overcomes previous limitations of light emitting field emission devices. In particular, minimum gap and direct injection techniques lower the required operating voltages of the device. Further, fabrication of a tri-chromic device capable of producing light of any visible color is set forth.

The present FED as applied to an associated display has significant advantages over prior display technologies. Specifically, the "speed" of the FED display devices is limited primarily by the "speed" of the phosphor used, however, phosphors are currently available that provide light-dark switching times at rates far in excess of human perception. Thus, a "real-time" display is achieved. Further, extremely small displays with very high resolution are possible. As an example, if the size of each multi-chromic FED is approximately 4 microns, a full color display with a resolution of 5,000 pixels by 5,000 pixels may be formed on a square chip 2 cm on each side. This is approximately the resolution of the human eye including peripheral vision. Thus, if two such chips are mounted in an appropriate fixture (a helmet, mask, pair of glasses, etc.), a fully high-resolution immersive virtual reality display device can be produced.

For all of the above reasons, the tri-chromic FED and associated display of the present invention represent a significant advancement in the state of the art of microelectronic display elements and associated displays.

While the invention has been described in detail herein, in accordance with certain preferred embodiments thereof, many modifications and changes therein may be affected by those skilled in the art. Accordingly, it is intended by the appended claims to cover all such modifications and changes as fall within the true spirit and scope of the invention.

What is claimed is:

1. A method for forming a field emission device ("FED") having a plurality of emission regions, said method comprising the steps of:

(a) providing a substrate having a main surface;

(b) forming a plurality of lateral emitters above said main surface of said substrate, each lateral emitter of said plurality of lateral emitters being separately electrically controllable; and (c) forming a phosphor structure above said main surface of said substrate, said phosphor structure having a plurality of emission regions disposed such that each emission region of said plurality of emission regions is associated with a different lateral emitter of said plurality of lateral emitters and electrons emitted by each lateral emitter progress parallel to said main surface of said substrate into the associated emission region of said phosphor structure thereby causing an electromagnetic emission from said associated emission region.

2. The method of claim 1, further including forming a filter in association with a selected emission region of said plurality of emission regions of said phosphor structure such that a preselected wavelength of electromagnetic energy is emitted from said filter when electrons are emitted from the lateral emitter associated with said selected emission region.

3. A method for forming a field emission device ("FED") having a plurality of emission regions, said method comprising the steps of:

(a) providing a substrate having a main surface;

(b) forming a plurality of lateral emitters above said main surface of said substrate, each lateral emitter of said plurality of lateral emitters being separately electrically controllable;

(c) forming a phosphor structure above said main surface of said substrate, said phosphor structure having a plurality of emission regions disposed such that each emission region of said plurality of emission regions is associated with a different lateral emitter of said plurality of lateral emitters, wherein electrons emitted by each lateral emitter progress parallel to said main surface of said substrate into the associated emission region of the phosphor structure, thereby causing an electromagnetic emission from said associated emission region; and wherein said lateral emitter forming step (b) comprises forming three lateral emitters, and wherein said phosphor structure forming step (c) comprises forming said phosphor structure with three emission regions, said method further including forming a first color filter in association with a first emission region of said three emission regions, a second color filter in association with a second emission region of said three emission regions, and a third color filter in association with a third emission region of said three emission regions so as to facilitate tri-chromic emission of light from said FED when electrons are emitted from said plurality of lateral emitters into said three emission regions of said phosphor structure.

4. The method of claim 3, wherein said filter forming step includes forming said first color filter as a red color filter, said second color filter as a blue color filter, and said third color filter as a green color filter such that when electrons are emitted into said emission regions of said FED, primary colors of light are emitted from said FED.

5. A method for forming a field emission device ("FED") having a plurality of emission regions, said method comprising the steps of:

(a) providing a substrate having a main surface;

(b) forming a plurality of emitters above said main surface of said substrate, each emitter of said plurality of emitters being separately electrically controllable;

(c) forming a phosphor structure, said phosphor structure being disposed above said main surface of said substrate, said phosphor structure having a plurality of emission regions such that each emission region of said plurality of emission regions is associated with a different emitter of said plurality of emitters, wherein electrons emitted by each emitter into the phosphor structure cause an electromagnetic emission from said associated emission region; and wherein said phosphor structure forming step (c) comprises forming said phosphor structure as a phosphor layer, said method further comprising forming an anode above the substrate of the FED, said anode having a triangular prismatic shape such that said anode has three lateral surfaces, each lateral surface of said three lateral surfaces being perpendicular to said main surface of said substrate and having said phosphor layer adjacent thereto, wherein each emission region of said three emission regions is associated with a different lateral surface of said three lateral surfaces of said anode.

6. A method for forming a field emission device ("FED") having a plurality of emission regions, said method comprising the steps of:

(a) providing a substrate having a main surface;

(b) forming a plurality of lateral emitters above said main surface of said substrate, each lateral emitter having a substantially planar shape and being disposed substantially parallel to the main surface of said substrate, and each lateral emitter of said plurality of lateral emitters being separately electrically controllable;

(c) forming a phosphor structure, said phosphor structure being disposed above said main surface of said substrate, said phosphor structure having a plurality of emission regions such that each emission region of said plurality of emission regions is associated with a different lateral emitter of said plurality of lateral emitters, wherein electrons emitted by each lateral emitter into said phosphor structure cause an electromagnetic emission from said associated emission region; and wherein said lateral emitter forming step (b) comprises forming each lateral emitter of said plurality of lateral emitters to have a tip, each tip being pointed towards said phosphor structure such that each tip is associated with said emission region of each lateral emitter for facilitating the transfer of electrons from said tip to said phosphor structure.

7. The method of claim 6, wherein said phosphor structure forming step (c) comprises forming said phosphor structure as an insulative-type phosphor structure such that the tip of each lateral emitter physically contacts said insulative-type phosphor structure such that electrons emitted from the tip of each lateral emitter are directly injected into said insulative-type phosphor structure causing an electromagnetic emission from an associated emission region of said insulative-type phosphor structure.

8. The method of claim 6, wherein said phosphor structure forming step (c) comprises forming said phosphor structure such that the tip of each lateral emitter is spaced from said phosphor structure a distance less than a mean free distance of an electron in air for facilitating transfer of electrons emitted by the tip of each lateral emitter into said phosphor structure.

9. A method for forming a field emission device ("FED") having a plurality of emission regions, said method comprising the steps of:

(a) providing a substrate having a main surface;

(b) forming a plurality of emitters above said main surface of said substrate, each emitter of said plurality of emitters being separately electrically controllable;

(c) forming a phosphor structure, said phosphor structure being disposed above said main surface of said substrate, said phosphor structure having a plurality of emission regions such that each emission region of said plurality of emission regions is associated with a different emitter of said plurality of emitters, wherein electrons emitted by each emitter into the phosphor structure cause an electromagnetic emission from said associated emission region; and wherein said providing step (a) further comprises providing said substrate having an insulating layer disposed thereabove, and wherein said emitter forming step (b) comprises forming said plurality of emitters on said insulating layer, and wherein said phosphor structure forming step (c) further comprises etching a hole in said insulating layer, said hole intersecting said plurality of emitters, and depositing said phosphor structure as a conformal phosphor layer above an interior surface of said insulating layer defined by said hole.

10. The method of claim 9, including forming an anode by filling an open portion of said hole with a conductor after said conformal phosphor layer forming step (c).

11. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of lateral emitters above said main surface of said substrate, each lateral emitter of said plurality of lateral emitters being separately electrically controllable; and (c) forming a phosphor structure above said main surface of said substrate, said phosphor structure having, a plurality of emission regions disposed such that each emission region of said plurality of emission regions is associated with a different lateral emitter of said plurality of lateral emitters and electrons emitted by each lateral emitter progress parallel to said main surface of said substrate into the associated emission region of said phosphor structure, thereby causing an electromagnetic emission from said associated emission region.

12. The method of claim 11, wherein forming each FED of said plurality of FEDs further includes forming an anode having a first surface, said first surface of said anode having said phosphor structure adjacent thereto, and wherein said method further includes electrically interconnecting the anodes of at least some FEDs of said plurality of FEDs for facilitating addressing of said at least some FEDs within said display matrix.

13. The method of claim 11, said method further including forming a shared lateral emitter comprising a lateral emitter associated with a first emission region of a first FED of said plurality of FEDs and a lateral emitter associated with a first emission region of a second FED of said plurality of FEDs, said second FED being adjacent to said first FED within said display matrix, wherein said shared lateral emitter facilitates addressing of said first FED and said second FED.

14. The method of claim 11 wherein forming each FED of said plurality of FEDs includes forming a filter in association with a selected emission region of said plurality of emission regions of each FED such that a preselected wavelength of electromagnetic energy is emitted from said filter when electrons are emitted from the lateral emitter associated with said selected emission region of each FED.

15. The method of claim 14, wherein for each FED of said plurality of FEDs said lateral emitter forming step (b)

comprises forming three lateral emitters, and said phosphor structure forming step (c) comprises forming said phosphor structure with three emission regions, and wherein forming each FED of said plurality of FEDs further includes forming a first color filter in association with a first emission region of said three emission regions, a second color filter in association with a second emission region of said three emission regions, and a third color filter in association with a third emission region of said three emission regions so as to facilitate tri-chromic emission of light from each FED when electrons are emitted into said emission regions of each FED.

16. The method of claim 15, wherein said filter forming steps for each FED of said plurality of FEDs further includes forming said first color filter as a red color filter, said second color filter as a blue color filter, and said third color filter as a green color filter such that when electrons are emitted into said emission regions of each FED, primary colors of light are emitted from each FED.

17. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of emitters above said main surface of said substrate, each emitter of said plurality of emitters being separately electrically controllable; and (c) forming a phosphor structure, said phosphor structure being disposed above said main surface of said substrate, said phosphor structure having a plurality of emission regions such that each emission region of said plurality of emission regions is associated with a different emitter of said plurality of emitters, wherein electrons emitted by each emitter into said phosphor structure cause an electromagnetic emission from said associated emission region;

wherein said method further includes forming a shared emitter comprising an emitter associated with a first emission region of a first FED of said plurality of FEDs and an emitter associated with a first emission region of a second FED of said plurality of FEDs, said second FED being adjacent to said first FED within said display matrix, wherein said shared emitter facilitates addressing of said first FED and said second FED; and wherein said method further includes forming a filter of a first color associated with said first emission region of said first FED, and forming a filter of said first color associated with said first emission region of said second FED for facilitating addressing of said display matrix.

18. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of emitters above said main surface of said substrate, each emitter of said plurality of emitters being separately electrically controllable; and (c) forming a phosphor structure, said phosphor structure being disposed above said main surface of said substrate, said phosphor structure having a plurality of emission regions such that each emission region of said plurality of emission regions is associated with a different emitter of said plurality of emitters, wherein electrons emitted by each emitter into said phosphor structure cause an electromagnetic emission from said associated emission region;

wherein said method further includes forming a shared emitter comprising an emitter associated with a first emission region of a first FED of said plurality of FEDs and an emitter associated with a first emission region of a second FED of said plurality of FEDs, said second FED being adjacent to said first FED within said display matrix, wherein said shared emitter facilitates addressing of said first FED and said second FED; and wherein said step of forming said shared emitter further includes forming said shared emitter having two tips, said two tips being disposed at opposite ends of said shared emitter such that a first tip of said two tips is associated with said first emission region of said first FED, and a second tip of said two tips is associated with said first emission region of said second FED.

19. The method of claim 18, wherein said first FED, said second FED and said shared emitter comprise an adjacent FED pair, and wherein said method further includes forming said display to include a plurality of adjacent FED pairs, and electrically interconnecting the shared emitters of at least some adjacent FED pairs of the plurality of adjacent FED pairs for facilitating addressing of said at least some adjacent FED pairs of said display matrix.

20. The method of claim 19, said method including forming said plurality of adjacent FED pairs having electrically interconnected shared emitters in a column within said display matrix for facilitating addressing of said plurality of FEDs.

21. The method of claim 11, wherein said phosphor structure forming step (c) comprises for each FED of said plurality of FEDs forming said phosphor structure as an insulative-type phosphor structure, said insulative-type phosphor structure being formed such that each lateral emitter of said plurality of lateral emitters of each FED of said plurality of FEDs physically contacts said insulative-type phosphor structure, wherein electrons emitted by each lateral emitter are directly injected into said insulative-type phosphor structure causing an electromagnetic emission from an associated emission region of said insulative-type phosphor structure.

22. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of emitters above said main surface of said substrate, each emitter of said plurality of emitters being separately electrically controllable;

(c) forming a phosphor structure, said phosphor structure being disposed above said main surface of said substrate, said phosphor structure having a plurality of emission regions such that each emission region of said plurality of emission regions is associated with a different emitter of said plurality of emitters, wherein electrons emitted by each emitter into said phosphor structure cause an electromagnetic emission from said associated emission region;

wherein forming each FED of said plurality of FEDs includes forming a filter in association with a selected emission region of said plurality of emission regions of each FED such that a preselected wavelength of electromagnetic energy is emitted from said filter when electrons are emitted from the emitter associated with said selected emission region of each FED;

wherein for each FED of said plurality of FEDs said emitter forming step (b) comprises forming three emitters, and said phosphor structure forming step (c) comprises forming said phosphor structure with three emission regions, and wherein forming each FED of said plurality of FEDs further includes forming a first color filter in association with a first emission region of said three emission regions, a second color filter in association with a second emission region of said three emission regions, and a third color filter in association with a third emission region of said three emission regions so as to facilitate tri-chromic emission of light from each FED when electrons are emitted into said emission regions of each FED; and wherein said phosphor structure forming step (c) for each FED of said plurality of FEDs comprises forming said phosphor structure as a phosphor layer, and wherein forming each FED of said plurality of FEDs further includes forming an anode, said anode having a triangular prismatic shape such that said anode has three lateral surfaces, said three lateral surfaces being formed adjacent to said phosphor layer, and wherein each emission region of said three emission regions is associated with a different lateral surface of said three lateral surfaces.

23. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of lateral emitters above said main surface of said substrate, each lateral emitter of said plurality of lateral emitters being separately electrically controllable, and each lateral emitter having a substantially planar shape and being disposed substantially parallel to said main surface of said substrate; and (c) forming a phosphor structure, said phosphor structure being disposed above said main surface of said substrate, said phosphor structure having a plurality of emission regions such that each emission region of said plurality of emission regions is associated with a different lateral emitter of said plurality of emitters, wherein electrons emitted by each lateral emitter into said phosphor structure cause an electromagnetic emission from said associated emission region; and wherein said lateral emitter forming step (b) for each FED of said plurality of FEDs comprises forming each lateral emitter of said plurality of lateral emitters to have a tip, each tip being pointed towards said phosphor structure for facilitating the transfer of electrons from said tip to said phosphor structure.

24. A method for forming a display matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of emitters above said main surface of said substrate, each emitter of said plurality of emitters being separately electrically controllable; and (c) forming a phosphor structure, said phosphor structure being disposed above said main surface of said substrate, said phosphor structure having a plurality of emission regions such that each emission region of said plurality of emission regions is associated with a different lateral emitter of said plurality of emitters, wherein electrons emitted by each lateral emitter into said phosphor structure cause an electromagnetic emission from said associated emission region; and wherein said phosphor structure forming step (c) comprises for each FED of said plurality of FEDs forming said phosphor structure such that each emitter of each FED of said plurality of FEDs is spaced from said phosphor structure a distance less than a mean free distance of an electron in air to facilitate the transfer of electrons emitted by each emitter into said phosphor structure.

25. A method for forming a display, matrix comprising the step of forming a plurality of field emission devices ("FEDs") such that said plurality of FEDs are organized as said display matrix, each FED of said plurality of FEDs being formed according to the steps of:

(a) providing a substrate having a main surface;

(b) forming a plurality of emitters above said main surface of said substrate, each emitter of said plurality of emitters being separately electrically controllable; and (c) forming a phosphor structure, said phosphor structure being disposed above said main surface of said substrate, said phosphor structure having a plurality of emission regions such that each emission region of said plurality of emission regions is associated with a different lateral emitter of said plurality of emitters, wherein electrons emitted by each lateral emitter into said phosphor structure cause an electromagnetic emission from said associated emission region; and wherein said providing step (a) for each FED of said plurality of FEDs further comprises providing said substrate having an insulating layer disposed thereabove, and wherein said emitter forming step (b) for each FED of said plurality of FEDs comprises forming said plurality of emitters on said insulating layer, and wherein said phosphor structure forming step (c) for each FED of said plurality of FEDs further comprises etching a hole in said insulating layer, said hole intersecting said plurality of emitters, and depositing said phosphor structure as a conformal phosphor layer above an interior surface of said insulating layer defined by said hole.

26. The method of claim 25, wherein said method for forming each FED of said plurality of FEDs further includes forming an anode by filling an open portion of said hole with a conductor after said conformal phosphor layer forming step (c).

* * * * *